US005704290A

United States Patent [19]

Metrope et al.

[11] Patent Number: 5,704,290

[45] Date of Patent: Jan. 6, 1998

[54] DEVICE FOR CLEANING BEARING SURFACES ON ROTATING CYLINDERS

[75] Inventors: Jacques Metrope, Laigneville; Christophe Noiret, Rantigny; Georges Michel Seillan, Saint Just En Chaussee, all of France

[73] Assignees: Heidelberger Druckmaschinen AG, Heidelberg, Germany; Heidelberg Harris SA, Montataire Cedex, France

[21] Appl. No.: 681,299

[22] Filed: Jul. 22, 1996

[30] Foreign Application Priority Data

Jul. 21, 1995 [FR] France ..... 95 08878

[51] Int. Cl.[6] ..... B41F 35/00; B41L 41/00

[52] U.S. Cl. ..... 101/425; 101/424

[58] Field of Search ..... 101/425, 424, 101/423

[56] References Cited

U.S. PATENT DOCUMENTS

| | | | |
|---|---|---|---|
| 2,330,491 | 9/1943 | Huck | 184/102 |
| 2,525,982 | 10/1950 | Wescott | 101/425 |
| 3,309,993 | 3/1967 | Grembecki et al. | 101/425 |
| 3,952,654 | 4/1976 | Evans | 101/425 |
| 4,015,307 | 4/1977 | Kossak | 101/425 |
| 4,162,652 | 7/1979 | Rebel et al. | 101/425 |
| 4,704,964 | 11/1987 | Robertson | 101/425 |
| 4,757,763 | 7/1988 | Macphee et al. | 101/425 |
| 4,893,562 | 1/1990 | Robertson | 101/425 |
| 5,107,764 | 4/1992 | Gasparrini | 101/425 |
| 5,519,914 | 5/1996 | Egan | 101/425 |

FOREIGN PATENT DOCUMENTS 1 567 893 5/1980 United Kingdom .

*Primary Examiner*—Edgar S. Burr
*Assistant Examiner*—Leslie Grohusky
*Attorney, Agent, or Firm*—Herbert L. Lerner; Laurence A. Greenberg

[57] ABSTRACT

Device for cleaning cylinder bearers of rotary printing-unit cylinders having cylinder bearers mounted at respective end faces of at least two of the cylinders for attaining a defined spacing between respective axes of the two cylinders, the cylinder bearers being rotatable with the two cylinders, respectively, and being rollable on one another while being in continuous contact with one another, includes at least one cleaning element movable into engagement with a bearing surface of one of the cylinder bearers, respectively, by a pressure medium, and movable away from the bearing surface, the cleaning element being impregnatable with a fluid.

12 Claims, 8 Drawing Sheets

DEVICE FOR CLEANING BEARING SURFACES ON ROTATING CYLINDERS

BACKGROUND OF THE INVENTION

FIELD OF THE INVENTION

The invention relates to a device for cleaning bearing surfaces on rotating cylinders and, more particularly, for cleaning cylinder bearer or Schmitz ring surfaces on cylinders of printing units of rotary printing presses.

The published German Patent Document DE 27 01 637 C2 discloses a cylinder bearer or Schmitz ring for rotary printing units. The cylinder bearer or Schmitz ring disclosed therein is transversely divided in an axially directed plane, the separation surfaces having a sawtooth shape and engaging in or meshing with one another. A number of holes is provided in a region of the cylinder bearer adjacent the axis thereof for receiving threaded bolts therein for connecting both of the cylinder-bearer halves.

The published German Patent Document DE 27 53 284 C2 is concerned with an arrangement of cylinder bearers or Schmitz rings disposed between two cylinders of a printing unit. In this arrangement, at least one cylinder bearer in the printing unit is provided with an elastic inner ring acting as a damping element. By means of eccentric pins, first holes formed in a cylinder bearer in an arrangement which is not in a straight line are brought into alignment, respectively, with second holes formed in a respective end face of the printing-unit cylinder, so as to compensate for or correct concentricity defects in order to reduce wear on the cylinder bearer or Schmitz ring.

The published German Patent Document DE 29 10 391 C2 is concerned with an arrangement for fixing thrust rings on journals of printing-press cylinders. The thrust rings disposed on the journals of the printing-unit cylinders are mounted by means of a pressure coupling between the seats or the bearing surfaces of the thrust rings and of the cylinder journals, channels being provided in one of these elements for supplying a pressure medium to the seats or bearing surfaces. The bearing surfaces of the thrust rings and of the cylinder journals are formed of two cylindrical segments lying in tandem and having diameters differing slightly from one another. The feed channels for the pressure medium are arranged in the thrust ring, ending in an offset zone between the cylindrical segments.

The published German Document DE 30 45 384 A1 discloses a cylinder for printing units of rotary printing presses. On the end faces of the cylinder, cylinder bearers or Schmitz rings are provided which are fixed to the cylinder, centered with respect to the rotational axis thereof. The centering is effected by a centering edge and by a conical surface formed on a centering ring, both of which are adjusted with respect to one another, so that the centering edge is elastically and plastically deformed after the centering and fixing operation.

The concepts briefly outlined hereinbefore, which are known in the state of the art, are concerned only with the respective centering and mounting or assembly of cylinder bearers or Schmitz rings and provide no information whatsoever about protecting the bearing surfaces from impurities and about removing impurities therefrom, respectively.

SUMMARY OF THE INVENTION

It is accordingly an object of the invention to provide a device for cleaning bearing surfaces on rotary cylinders which avoids overheating of the cylinder bearers or Schmitz rings and effects a remotely-controlled cleaning of the bearing surfaces.

With the foregoing and other objects in view, there is provided, in accordance with the invention, a device for cleaning cylinder bearers of rotary printing-unit cylinders having cylinder bearers mounted at respective end faces of at least two of the cylinders for attaining a defined spacing between respective axes of the two cylinders, the cylinder bearers being rotatable with the two cylinders, respectively, and being rollable on one another while being in continuous contact with one another, comprising at least one cleaning element movable into engagement with a bearing surface of one of the cylinder bearers, respectively, by a pressure medium, and movable away from the bearing surface, said cleaning element being impregnatable with a fluid.

In accordance with another feature of the invention, the cleaning device includes a respective guide surrounding the cleaning element.

In accordance with a further feature of the invention, the cleaning device includes a chamber defined by the cleaning element conjointly with the guide, and a pressure line terminating in the chamber.

In accordance with an added feature of the invention, the cleaning device includes a lockable closure for an opening formed in the guide.

In accordance with an additional feature of the invention, the at least one cleaning element covers the width of the bearing surface of the respective cylinder bearer.

In accordance with yet another feature of the invention, the cleaning device includes a fluid supply line connected to the pressure line for injecting the fluid into the pressure line.

In accordance with yet a further feature of the invention, the fluid supply line is formed with a venturi nozzle.

In accordance with yet an added feature of the invention, the cleaning device includes a fluid reservoir, and a fluid supply line connected to the fluid reservoir and directly terminating in the cleaning element for introducing the fluid into the cleaning element.

In accordance with yet an additional feature of the invention, the cleaning device includes a regulatable fluid supply and a fluid supply line connected to the fluid supply and terminating in the guide for introducing the fluid into the cleaning element.

In accordance with still another feature of the invention, the cleaning element has a rounded cleaning surface at an end face thereof directed towards the respective bearing surface.

In accordance with still a further feature of the invention, the cleaning device includes a negative pressure source connectible with the guide for subjecting the guide to negative pressure so that a restoring movement by which the cleaning element is moved away from the respective bearing surface is imparted to the cleaning element in the guide.

In accordance with a concomitant feature of the invention, the cleaning device includes a restoring element braced against the closure and connected to the cleaning element for moving the cleaning element away from the respective bearing surface and for restoring the cleaning element to an initial position thereof.

The advantages afforded by the construction according to the invention are notably that one or more cleaning elements are engageable with the bearing surfaces of the cylinder bearers for cleaning them, and are movable away from them after the cleaning, thereby avoiding any local overheating due to friction by the cylinder bearers. This is particularly important wherein low operating temperatures are required, for example, in the case of offset printing without a dampening solution. The impregnation of the cleaning elements with a fluid offers the possibility of loosening residues of ink or paper which may have dried on the bearing surfaces and immediately removing them from the bearing surfaces of the cylinder bearers before the printing is impaired thereby. Moreover, a remotely-controlled cleaning device conforms to the safety rules applicable to pressmen, because they do not have to work in the nip between the cylinder bearers, which roll on one another, due to the fact that the cleaning elements are automatically engageable and disengageable, i.e., move in and out, respectively.

In accordance with a development of the concept based upon the invention, the cleaning elements are surrounded by guides. Together with the guides, the cleaning elements define chambers in which pressure lines terminate in order to drive the cleaning elements, respectively, into and out of the guides in accordance with a respective pressure increase and decrease. The guides themselves can be provided with lockable caps, on which also restoring devices may be mounted for returning the cleaning elements to the initial position thereof in the guide members by spring force after depressurization of the chambers and for moving the cleaning elements away from the bearing surfaces of the cylinder bearers or Schmitz rings which are to be cleaned.

It is also possible to dispose several cleaning elements adjacent one another or superimposed on one another in corresponding guides, so as to cover and clean the whole width or breadth of the bearing surfaces of the cylinder bearers.

In order to maintain the cleaning elements continuously impregnated with the fluid, the latter can be injected into the pressure supply line through a separate fluid supply line. The fluid then moistens the surface of the respective cleaning element facing towards the pressure chamber, penetrates the cleaning element and impregnates it until the cleaning surface of the cleaning element facing towards the bearing surface of the respective cylinder bearer is also wetted.

The fluid supply line which terminates in the pressure supply line can be formed either with or without a nozzle-type narrowing or constriction of the cross section thereof, for example, a venturi nozzle. The fluid supply can also be provided by means of a displaceable fluid reservoir which is connected to the cleaning element by a supply line and is movable in directions parallel to the inwardly and outwardly movable cleaning element. Besides this construction based upon a movement of the fluid by gravity, the fluid can also be supplied in a controlled or regulated manner, at cyclical and freely selective time intervals.

For effecting an improved conformation or tight engagement of the respective cleaning elements to the respective bearing surfaces of the cylinder bearers or Schmitz rings, the cleaning elements are formed with a rounded contour.

Besides the possibility mentioned hereinbefore for restoring the cleaning elements by spring force, they may also be driven back into the guides by subjecting the respective guide chambers to negative pressure.

Other features which are considered as characteristic for the invention are set forth in the appended claims.

Although the invention is illustrated and described herein as embodied in a device for cleaning bearing surfaces of rotating cylinders, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
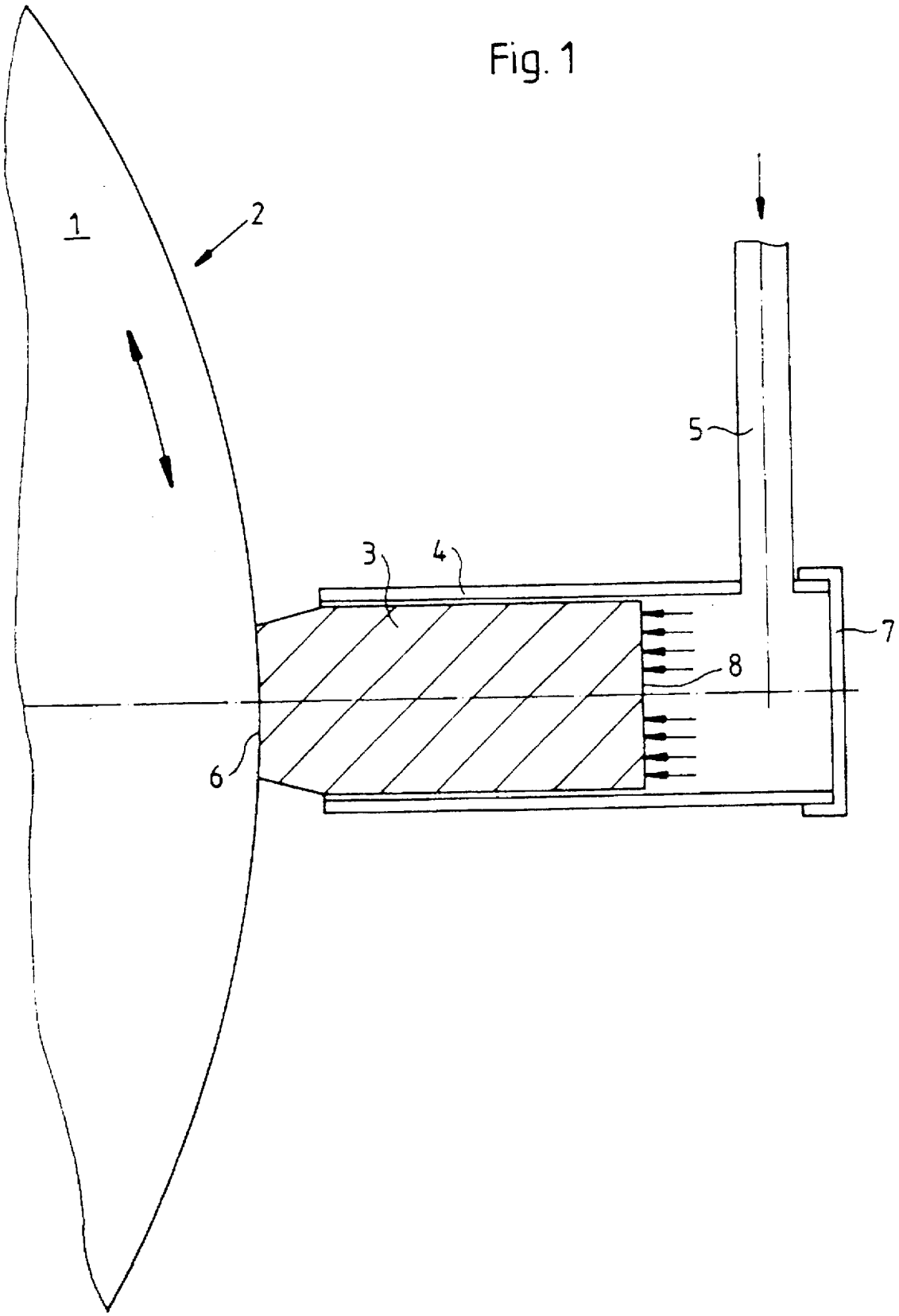
FIG. 1 is a diagrammatic side elevational view, partly in section, of a first embodiment of a cleaning device according to the invention, which is received in a guide so as to be guidable thereby into engagement with a bearing surface of a cylinder bearer or Schmitz ring.

Referring now to the drawings and, first, particularly to FIG. 1 thereof, there is shown therein diagrammatically a cleaning device according to the invention.

A movable cleaning element 3 formed of felt or other porous material is housed in a guide 4. On an end face of the cleaning element 3 directed towards a bearing surface 2 of a cylinder bearer or Schmitz ring 1 and hereinafter referred to as the cleaning surface 6 thereof, the cleaning element 3 has a rounded contour which closely hugs or engages the curvature of the bearing surface 2 of the cylinder bearer or Schmitz ring 1. The cleaning element 3 is formed with an opposite end face which constitutes an active surface 8 thereof, by means of which a pressure or propelling medium supplied by a pressure line 5 acts upon the cleaning element 3. The pressure medium may be air, for example. The guide 4 wherein the cleaning element 3 is received is closed off by a closure or cap 7. When a chamber defined by the active surface 8 of the cleaning element 3, the guide surfaces of the guide 4, and the closure cap 7 is pressurized, the cleaning element 3 which is impregnated with cleaning fluid is moved into contact with the bearing surface 2 of the cylinder bearer or Schmitz ring 1 and cleans the latter. When the pressure line 5 is depressurized or subjected to negative pressure, the cleaning element 3 withdraws from or lifts off the bearing surface 2 of the cylinder bearer or Schmitz ring 1, and thus loses all contact with this bearing surface and so does not cause overheating of the cylinder bearer or Schmitz ring 1 by friction.

Figure 2:
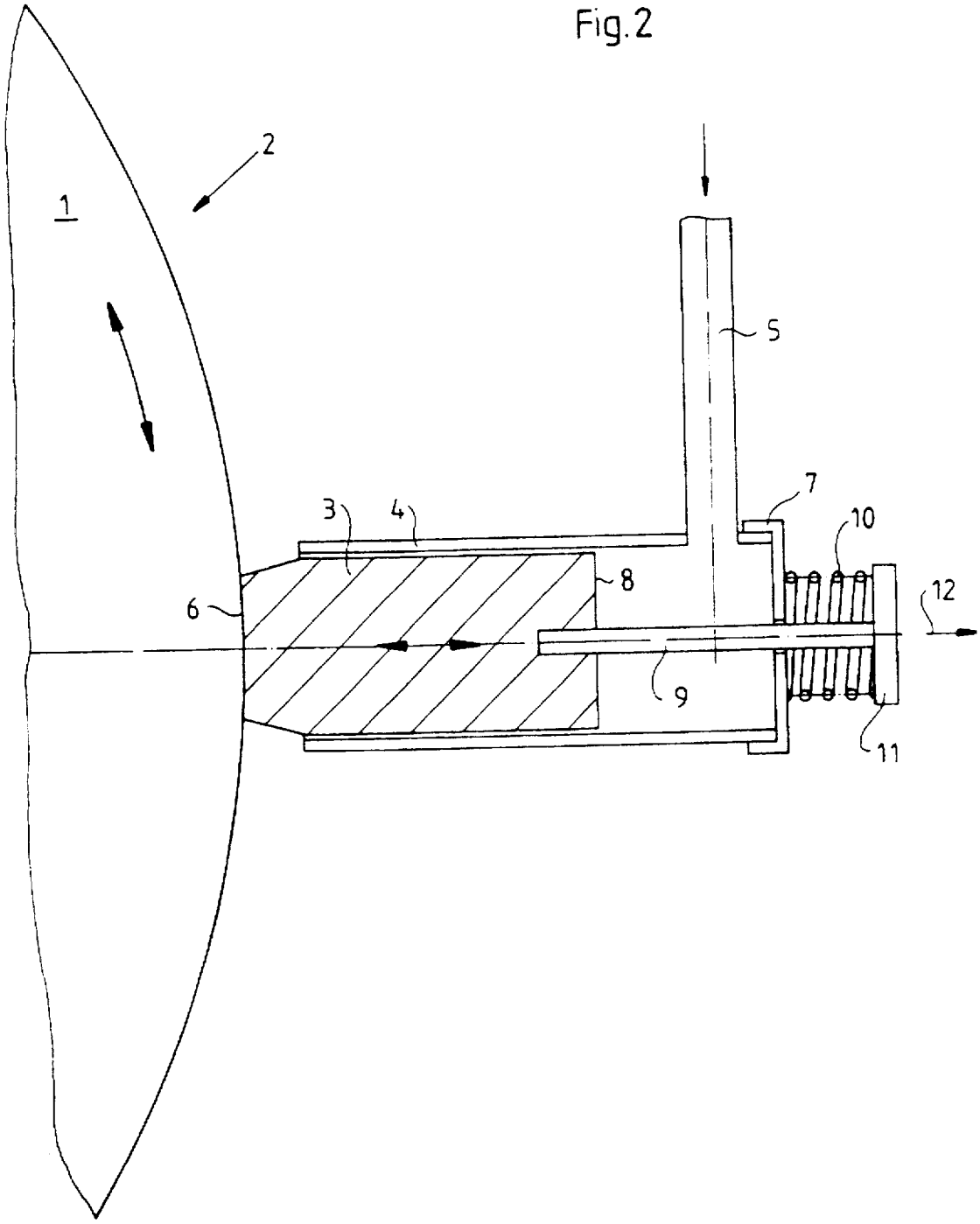
FIG. 2 is another view like that of FIG. 1 of a second embodiment of the cleaning device, wherein a restoring element is mounted on a closure, i.e., a cap, of the guide.

In the embodiment of the invention shown in FIG. 2, the cleaning element 3 is provided with a rod-shaped element 9 which extends through the closure cap 7 and is supported on the latter by means of a cover 11 and a spring 10. When the pressure line 5 is depressurized, the spring 10, which is compressed when the cleaning element 3 is pressed against the bearing surface 2 of the cylinder bearer or Schmitz ring 1, returns to the initial position thereof inside the guide 4. In this embodiment of the invention, a separate application of negative pressure is unnecessary, because the restoring movement (arrow 12) of the cleaning element 3 in a direction away from the bearing surface 2 is effected mechanically.

Figure 3:
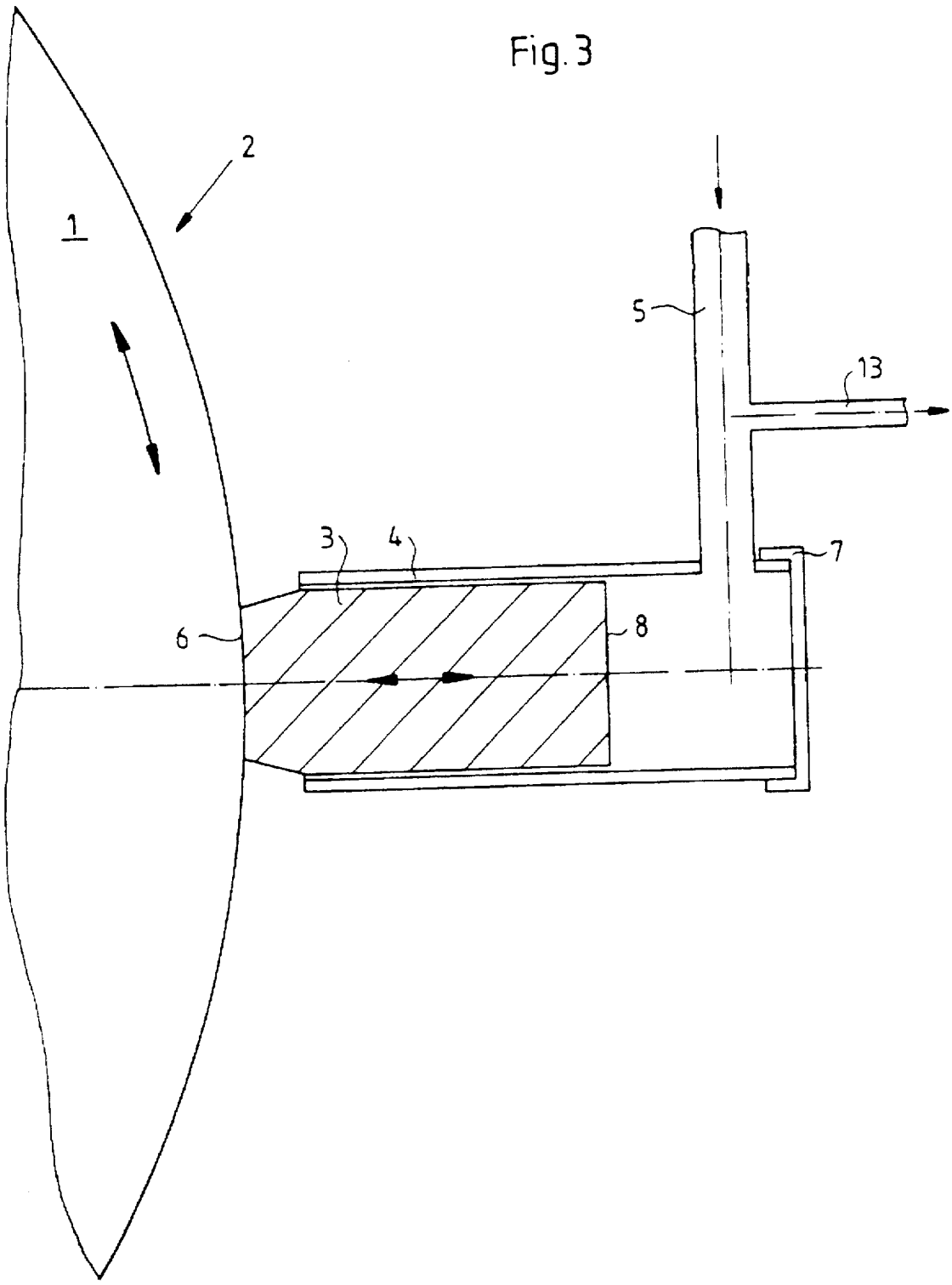
FIG. 3 is a further view like that of FIG. 1 of a third embodiment of the cleaning device, wherein a suction line branches from a pressure line and serves for returning the cleaning device to an original position thereof.

FIG. 3 shows another embodiment of the invention which is similar to the previously described embodiment of FIG. 1. In the embodiment of FIG. 3, a separate negative-pressure line 13 is connected to the pressure line 5 for producing a negative pressure inside the guide member 4 which results in a restoring movement of the cleaning element 3.

Figure 4:
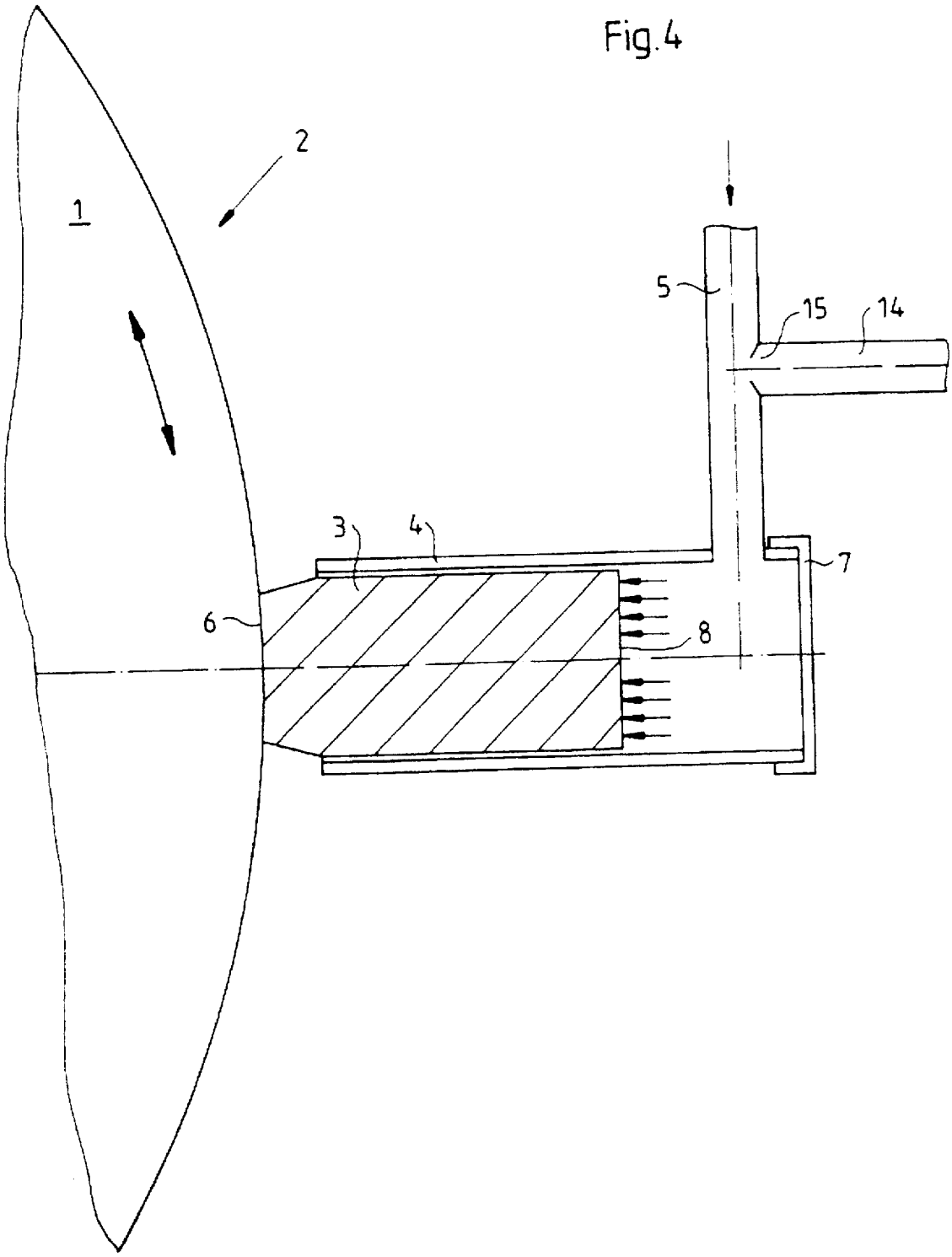
FIG. 4 is an added view like that of FIG. 1 of a fourth embodiment of the cleaning device, wherein a pressure supply line is provided a venturi nozzle.

A further different embodiment of the cleaning device according to the invention shown in FIG. 4 has a fluid supply line 14 which is connected to the pressure line 5. The fluid supplied through the line 14 may be oil, for example, or any other suitable cleaning medium or solution. The fluid supply line 14 has a nozzle-type cross-sectional constriction 15 formed by way of example as a venturi tube. The impregnating fluid for the cleaning element 3 is injected into the pressure line 5 by the fluid supply line 14 and reaches the vicinity of the active surface 8 of the cleaning element 3. The impregnating fluid wets the active surface 8 and penetrates through the porous cleaning element 3 as far as the cleaning surface 6 thereof. The fluid is then deposited by the cleaning surface 6 of the cleaning element 3 on the bearing surface 2 of the cylinder bearer or Schmitz ring 1 when the cleaning element 3 is brought into engagement therewith, and accordingly loosens any dry residues thereon and removes them from the bearing surface 2.

Figure 5:
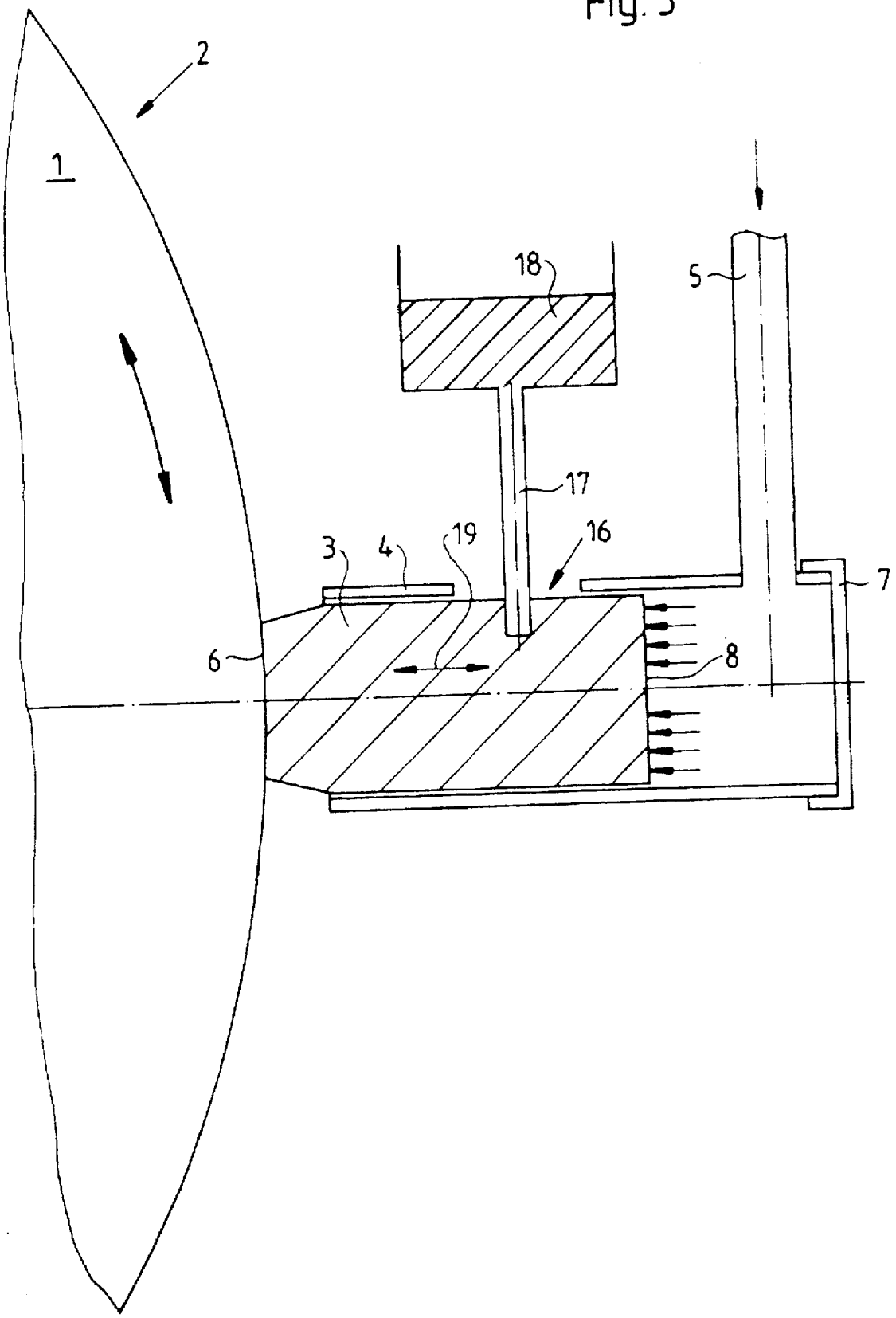
FIG. 5 is an additional view like that of FIG. 1 of a fifth embodiment of the cleaning device, wherein a fluid reservoir communicates with the cleaning device.

Another variation in the fluid supply is depicted in the embodiment of the cleaning device shown in FIG. 5. A reservoir 18 filled with cleaning fluid is shown therein connected to the cleaning element 3 by a flexible supply line 17 which passes through the guide 4 at an opening 16 which is formed therein and enables the cleaning element 3 to move respective limits of a range of positions represented by the arrow 19. In the exemplary embodiment depicted in FIG. 5, the application of pressure to the active surface 8 is effected by means of a pressure line 5 as explained hereinbefore. Due to the force of gravity acting upon the fluid, the addition of fluid is provided upon demand, in accordance with or depending upon the respective consumption of the fluid at the cleaning surface 6, with the result that the cleaning element 3 remains saturated with fluid at all times, by capillary action.

Figure 6:
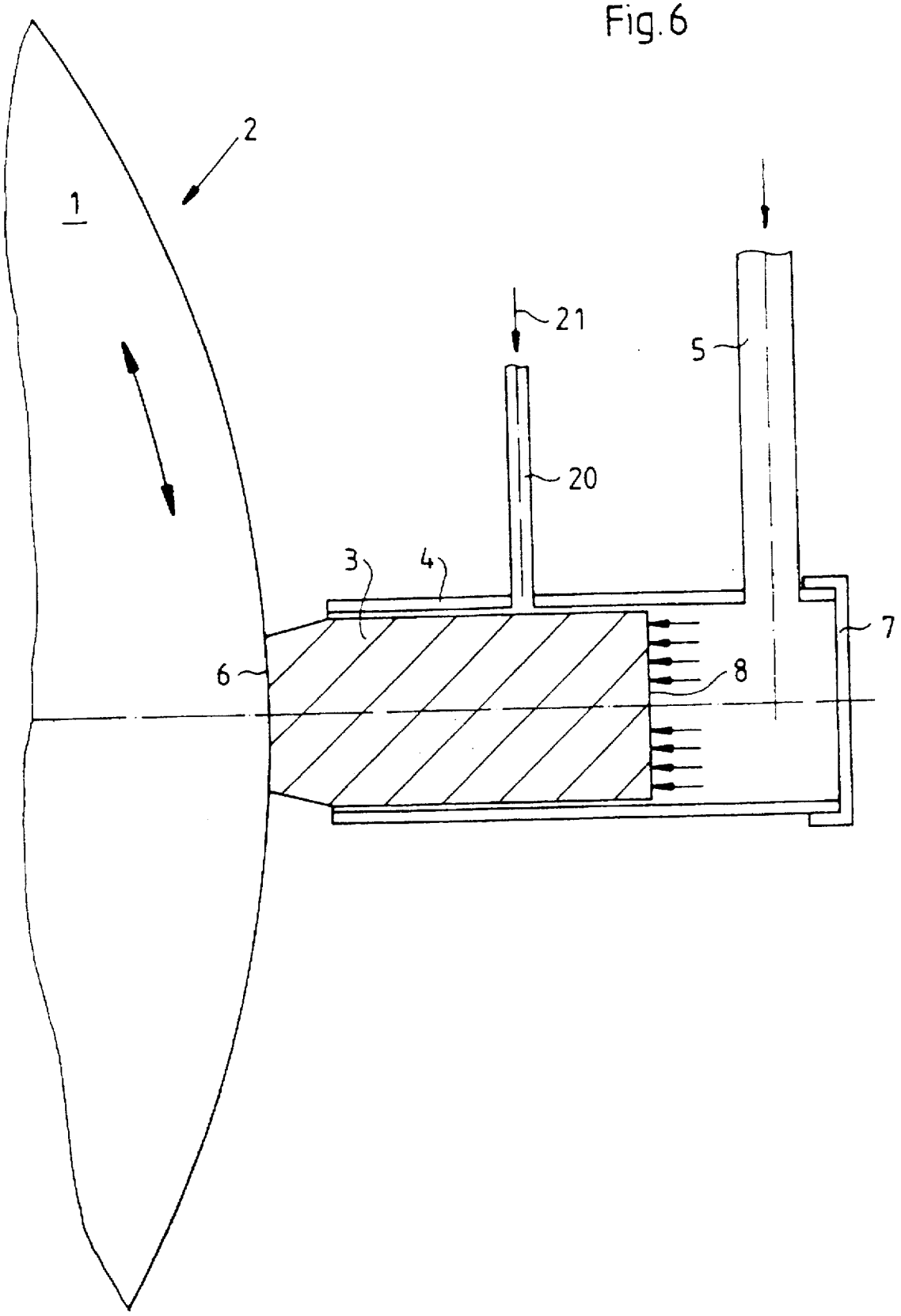
FIG. 6 is yet another view like that of FIG. 1 of a sixth embodiment of the cleaning device, which has a controlled or regulated fluid supply line connected thereto.

FIG. 6 shows an added embodiment according to the invention wherein the cleaning element 3 is supplied with cleaning fluid through the wall of the guide 4 by a controlled or regulated fluid supply 21 such as an oil supply, for example. In this case, the fluid is transmitted, at freely-selected regulated or controlled intervals, to the cleaning element 3 by a non-illustrated supply device. In this construction of the inventive cleaning device, the fluid supply line 20 is immovably, i.e., rigidly, connected to the guide 4.

Figure 7:
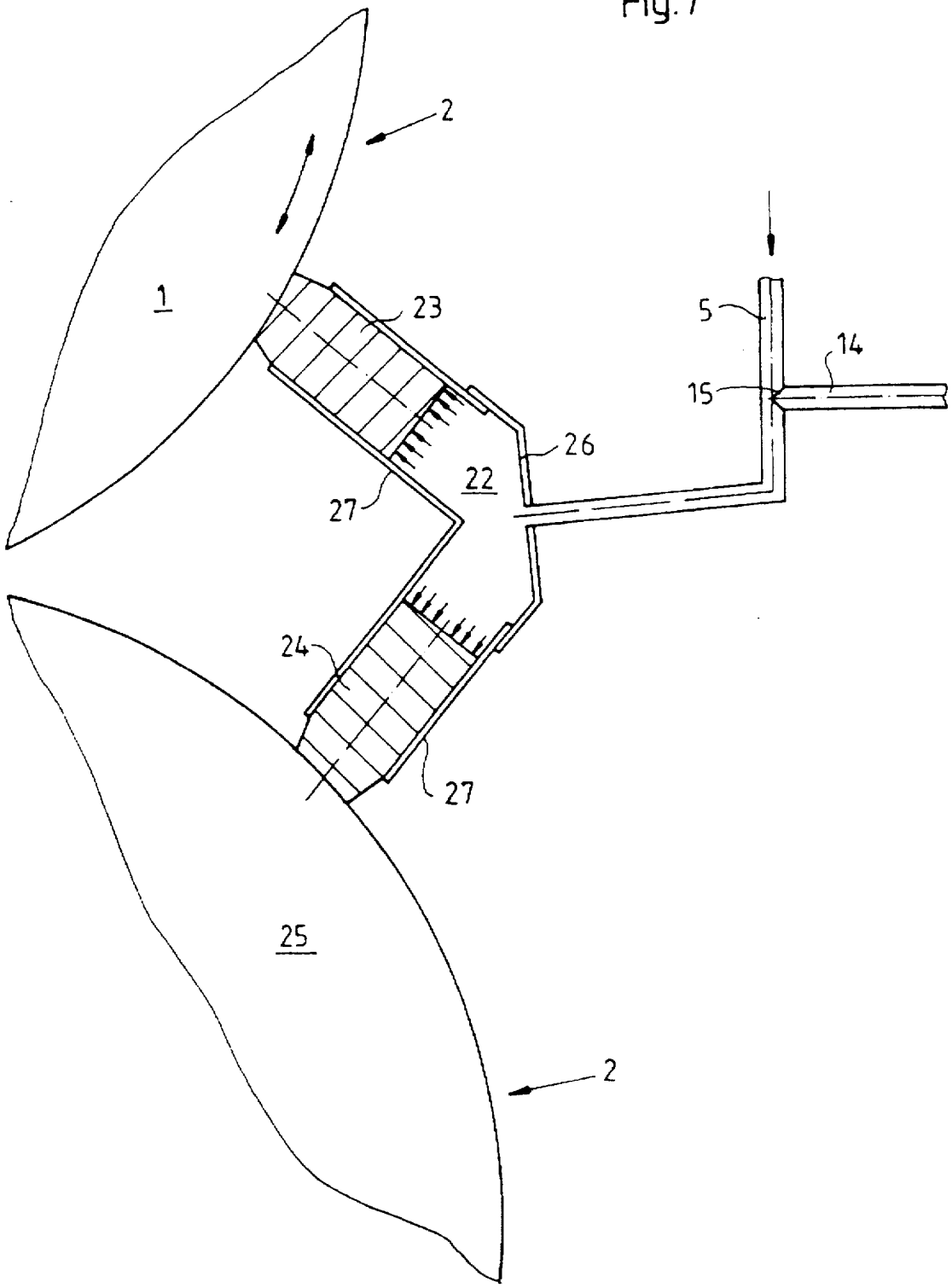
FIG. 7 is a diagrammatic side elevational view of a seventh embodiment of the cleaning device according to the invention, which is V-shaped and has two cleaners which are guidable into engagement, respectively, with bearing surfaces of two cylinder bearers or Schmitz rings.

FIG. 7 shows a V-shaped configuration of cleaning devices, wherein two cleaning elements 23 and 24 are received in a common guide body 27. The guide body 27 is provided with a closure cap 26 wherein a pressure line 5 terminates for pressurizing a chamber 22 formed in the guide body 27. The active surfaces of the cleaning elements 23 and 24 are depicted in FIG. 7 in a manner similar to that shown in the other figures of the drawings and are subjected to pressure so as to urge the cleaning elements 23 and 24 against the bearing surfaces 2 of the two cylinder bearers or Schmitz rings 1 and 25 which roll on one another. The cleaning elements 23 and 24 shown in FIG. 7 are formed of porous felt bodies or a suitable similar material. The fluid supply is effected via a separate fluid supply line 14 which mixes the fluid with the propelling or pressure medium in the pressure line 5. As noted hereinbefore, the transport of the cleaning fluid to the active surfaces of the cleaning elements 23 and 24, which cooperate with the bearing surfaces 2 of the cylinder bearers or Schmitz rings 1 and 25, is effected by the thrust imparted by the propelling or pressure medium. This variation in the construction of the device according to the invention thus enables the bearing surfaces 2 of two cylinder bearers or Schmitz rings 1 and 25 to be cleaned simultaneously.

Figure 8:
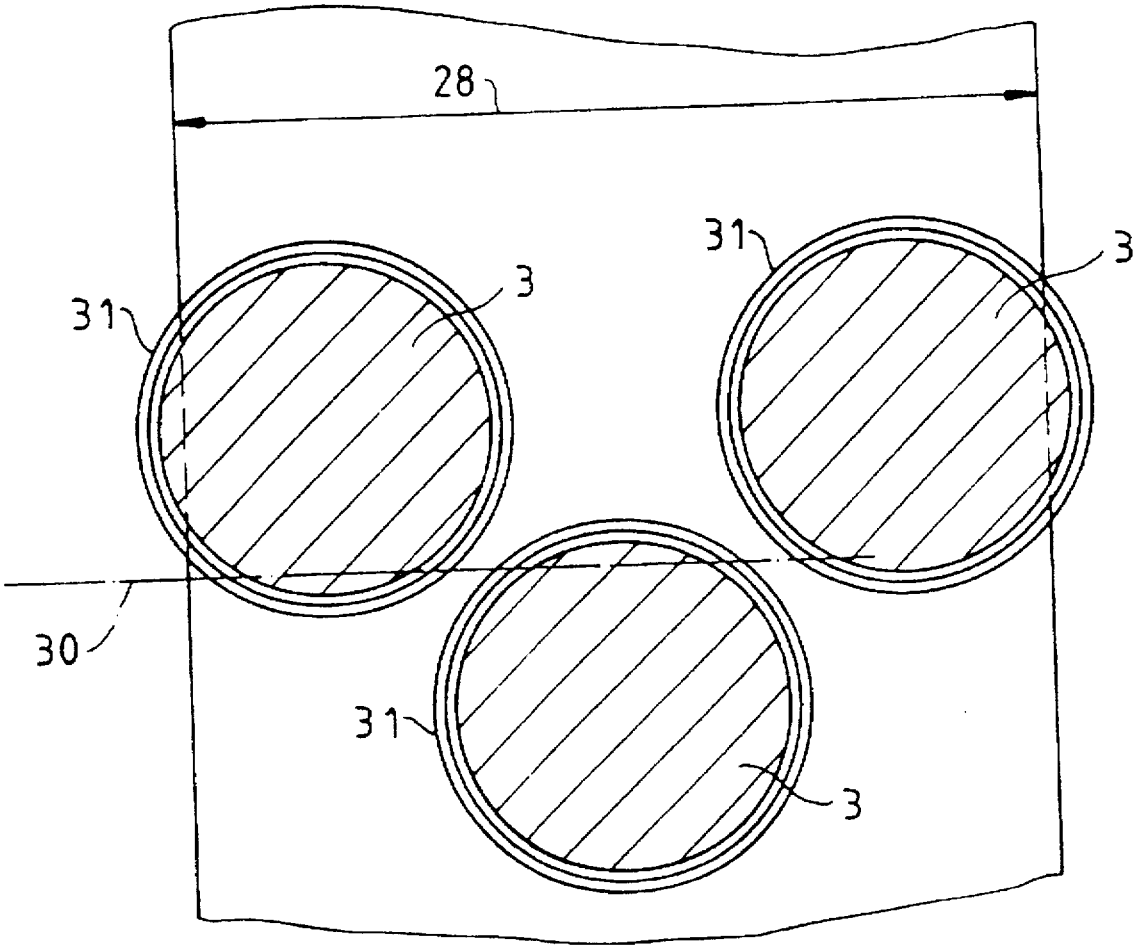
FIG. 8 is a diagrammatic cross-sectional view of three cleaning devices according to the invention, which are disposed side-by-side in respective guides, and cover the width or breadth of the bearing surface of a cylinder bearer or Schmitz ring.

FIG. 8 shows an arrangement according to the invention of several cleaning devices placed side by side. The cleaners 3 with a circular cross section are each guided in a guide member 31. In the example shown, the cleaners 3 are offset with respect to each other and juxtaposed, so as to cover the entire width of the running surface 28 of the bearer 1. The cleaners 3 are disposed approximately symmetrically to the rotational axis 30 of the bearer and of the cylinder. The partial overlapping adopted here for the cleaning surfaces enables the residues on the entire running surface 28 to be removed with certainty. The cleaners 3 can obviously have a cross section other than circular.

We claim:

1. Device for cleaning cylinder bearers of rotary printing-unit cylinders having cylinder bearers mounted at respective end faces of at least two of the cylinders for attaining a defined spacing between respective axes of the two cylinders, the cylinder bearers being rotatable with the two cylinders, respectively, and being rollable on one another while being in continuous contact with one another, comprising at least one cleaning element movable toward and into engagement with a bearing surface of one of the cylinder bearers, respectively, by a pressure medium, and movable away from the bearing surface, said cleaning element being impregnatable with a fluid; and a guide having guide surfaces surrounding said at least one cleaning element and providing a travel path for said at least one cleaning element in said movement toward and away from the bearing surface of one of the cylinder bearers.

2. Device according to claim 1, wherein said cleaning element has a middle section and an end section for absorbing the fluid and the fluid penetrates through said cleaning element to the bearing surface.

3. Device according to claim 2, wherein said guide has an opening formed therein and including a closure device for covering said opening by locking to said guide.

4. Device according to claim 3, including a restoring element braced against said closure and connected to said cleaning element for moving said cleaning element away from the respective bearing surface and for restoring said cleaning element to an initial position thereof.

5. Device according to claim 1, including a chamber defined by said cleaning element conjointly with said guide, and a pressure line terminating in said chamber.

6. Device according to claim 5, including a fluid supply line connected to said pressure line for injecting the fluid into said pressure line.

7. Device according to claim 6, wherein said fluid supply line has an end and a venturi nozzle is formed at said end.

8. Device according to claim 1, wherein said at least one cleaning element covers the width of the bearing surface of the respective cylinder bearer.

9. Device according to claim 1, including a fluid reservoir, and a fluid supply line connected to said fluid reservoir and directly terminating in said cleaning element for introducing the fluid into the cleaning element.

10. Device according to claim 1, including a regulated fluid supply and a fluid supply line connected to said fluid supply and terminating in said guide for introducing the fluid into said cleaning element.

11. Device according to claim 1, wherein said cleaning element has a rounded cleaning surface at an end face thereof directed towards the respective bearing surface.

12. Device according to claim 1, including a negative pressure source connectible with said guide for subjecting said guide to negative pressure so that a restoring movement by which said cleaning element is moved away from the respective bearing surface is imparted to said cleaning element in said guide.

* * * * *